US006468323B1

(12) United States Patent
Chwala

(10) Patent No.: US 6,468,323 B1
(45) Date of Patent: Oct. 22, 2002

(54) GREASE CONTAINMENT ASSEMBLY

(75) Inventor: Kevin Chwala, Barrington Hills, IL (US)

(73) Assignee: Omni Containment Systems, Inc.

( * ) Notice: Subject to any disclaimer, the term of this patent is extended or adjusted under 35 U.S.C. 154(b) by 0 days.

(21) Appl. No.: 09/900,549

(22) Filed: Jul. 9, 2001

(51) Int. Cl.[7] ..... B01D 35/02

(52) U.S. Cl. ..... 55/490; 55/DIG. 36; 126/299 R; 454/49

(58) Field of Search ..... 55/462, 502, 506, 55/507, DIG. 36, 490; 126/299 D, 299 E, 299 R, 300, 301; 454/49, 365

(56) References Cited

U.S. PATENT DOCUMENTS 4,635,617 A * 1/1987 Simonsen ..... 126/299 E
4,869,236 A * 9/1989 Blough ..... 126/299 E
4,887,588 A * 12/1989 Rial ..... 126/299 R
5,196,040 A 3/1993 Malloy et al.
5,318,607 A 6/1994 Malloy et al.
5,512,073 A 4/1996 Mirza et al.
5,567,216 A 10/1996 Mirza et al.
5,814,115 A * 9/1998 Allen et al. ..... 55/350.1
6,010,558 A 1/2000 Ackland
6,143,047 A 11/2000 Jodoin et al.

* cited by examiner

*Primary Examiner*—David A. Simmons
*Assistant Examiner*—Frank M. Lawrence
(74) *Attorney, Agent, or Firm*—Hamman & Benn; Adam K. Sacharoff

(57) ABSTRACT

A grease containment assembly to collect grease discharged from a grease exhaust system that has an exhaust duct extending upwardly from a roof top and interconnected to a fan base that connects to an exhaust fan. The grease containment includes a plurality of interconnecting U-shaped channels positioned around the exhaust duct to form a frame surrounding said exhaust duct. A sorbent material is further received within the interconnecting channels, having properties that absorbs grease and repels water. A plurality of holes is positioned in the interconnecting channels such that the water repelled by the sorbent material may drain out of the interconnecting channels. In addition the frame is further secured to the exhaust duct.

15 Claims, 4 Drawing Sheets

GREASE CONTAINMENT ASSEMBLY

FIELD OF THE INVENTION

This invention relates generally to a grease containment assembly for collecting grease discharged from vents.

BACKGROUND OF THE INVENTION

Restaurants, especially fast food establishments, produce high volumes of grease that is discharged through a roof-mounted exhaust system. The grease that is discharged may accumulate on the roof and cause deterioration and/or pose extreme fire hazards. Known attempts to contain the grease generally result in less that efficient means for containing the discharged grease.

One such attempt is disclosed in U.S. Pat. No. 5,196,040 entitled "Grease Trap and Filter Apparatus," ('040 patent) which the applicant herein co-invented. However, the '040 patent has numerous shortcomings. For instance, the filter assembly is designed and cut to fit snugly around the exhaust duct of an exhaust system. However, the grease may still easily run in between the duct and the filter spilling on to the roof.

U.S. Pat. No. 5,512,073 entitled "Grease Filter Assembly" ('073 patent) is another attempt to contain the grease that may be discharged through a roof top exhaust system. Similar to the above, the '073 patent also places the filter directed against the exhaust duct. However, the '073 patent is secured to the duct rather than the roof, allowing it to be placed on any roof, even if slanted.

U.S. Pat. No. 5,567,216 entitled "Grease Filter Assembly" ('216 patent) places a filter directed below the grease spout. However, it is well known that the grease has a tendency to expel from any openings in the seams around the entire perimeter of the exhaust duct, vent and under the fan base as well.

U.S. Pat. No. 6,010,558 entitled "Grease Containment System and Method for Absorbing Grease" ('558 patent) is directed to a system that uses a box to collect grease falling from the spout as well as a filter mat placed around the vent to collect run off grease. However, as the above-mentioned patents, the '558 patent is simply fitted about the exhaust duct such that the grease may fall in between the filter and the duct.

U.S. Pat. No. 6,143,047 entitled "Effluent Containment Assembly" is directed to a containment system for collecting grease or other effluents that dispense from a exhaust system. The various disclosed systems may be mounted to the duct above the roof and include a flashing member to direct the effluent downwardly and outwardly away from the vent. However, since the filter material is cut and sized about the duct, grease may still seep in between the filter and the duct and onto the roof.

As noted above, most grease containment assemblies use filters that are cut and sized to fit about the perimeter of the exhaust duct. In some instances the exhaust system includes a grease spout that is suppose to direct the grease into a small grease trap, as shown and described in U.S. Pat. Nos. 6,143,047 and 6,010,558. However, the grease has a tendency to seep through seems between the filter pads and the duct as well as around the fan base between the exhaust duct and fan. As such in each instance the grease will still saturate the roof causing deterioration and posing fire risks. A need therefore exists for improvements on the above-mentioned references in order to prevent the grease from saturating and deteriorating the roof.

SUMMARY OF THE INVENTION

In accordance with the present invention a grease containment assembly is described and disclosed herein below. The grease containment assembly includes a plurality of elongated members positioned about the perimeter of an exhaust system. Each elongated member has a bottom portion and two walls extending upwardly from the bottom portion, wherein one of the walls is positioned up against the exhaust duct defined in the exhaust system and the other wall is a predetermined distance therefrom defined by a width of the bottom portion. The containment assembly further includes a means for securing the elongated members against the exhaust duct, such as support brackets. A sorbet pad is sized to fit entirely within the elongated members and has properties to absorb grease and to permit water to drain through or repel therefrom. The elongated members further includes a plurality of drain hole interspaced about the bottom portion such that water not absorbed or repelled by the sorbet pad may drain from the containment assembly. Other embodiments include placing a mesh covering on top of the sorbent material to help prevent the sorbent material from moving.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
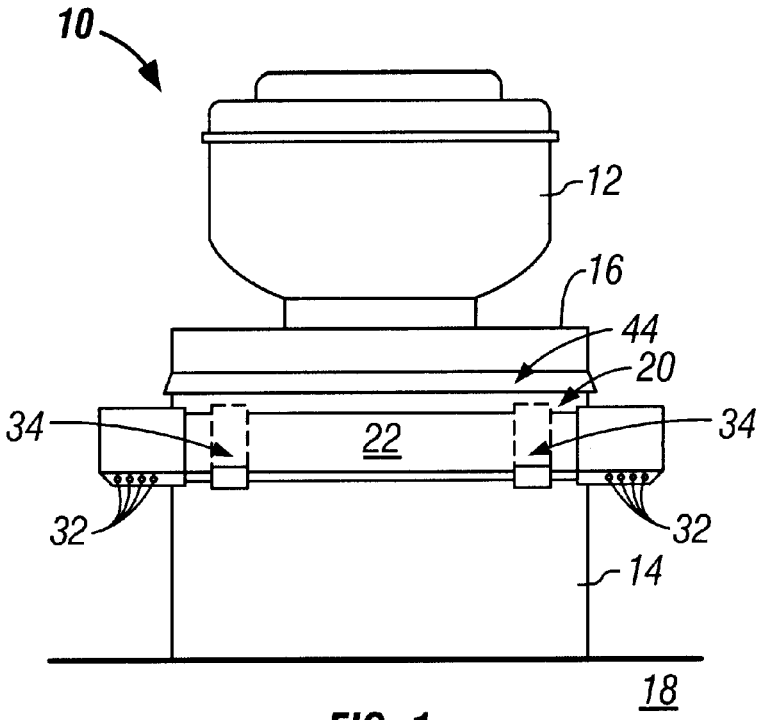
FIG. 1 is a side view of the grease containment assembly in accordance with the present invention attached to a typical grease exhaust system.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a grease containment assembly in accordance with the present invention is hereinafter generally referenced to numeral 20. The grease containment assembly 20 is to be used with a roof top grease exhaust system 10. The grease exhaust system 10 would typically include at least, an exhaust fan 12 and an exhaust duct 14 that protrudes from a roof 18 of a building, normally a fast food restaurant. The grease exhaust system 10 may also include a grease sprout (not shown) that aids in directing the discharged grease out of the exhaust system 10. While ideally grease is meant to collect and discharge through the grease sprout, the grease typically discharges around the fan base 16 that serves to connect the exhaust fan 12 to the exhaust duct 18. The grease containment assembly 20 of the present invention serves to solve the ever present problem of collecting the discharged grease.

Figure 2:
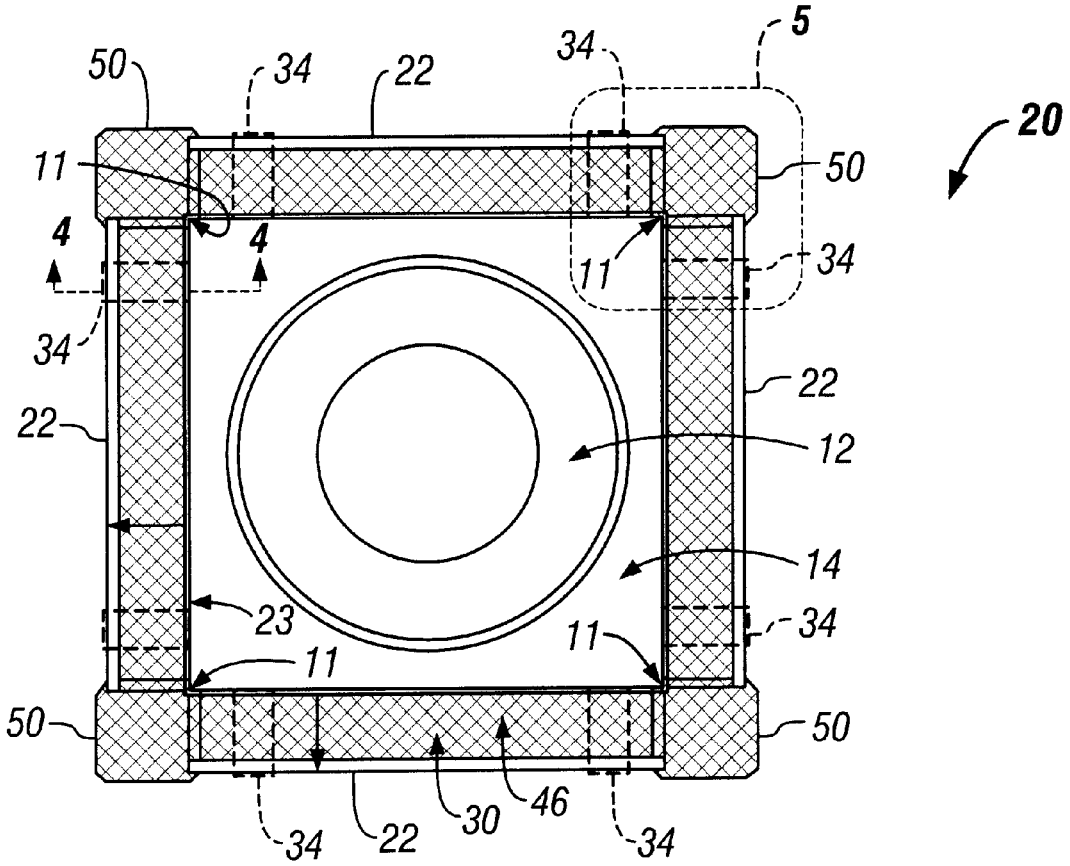
FIG. 2 is a top view of the grease containment assembly from FIG. 1.
Figure 4:
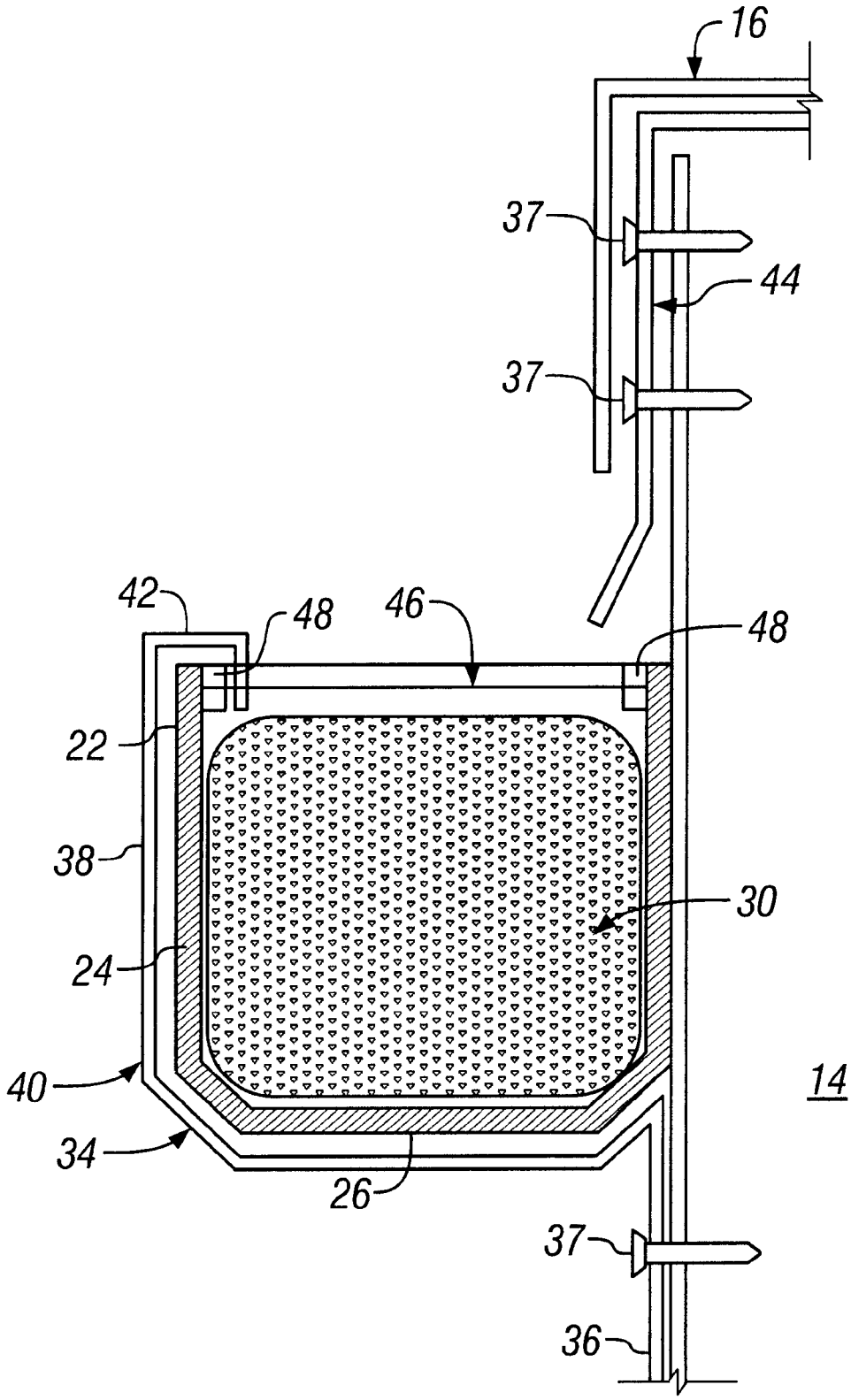
FIG. 4 is a front view of the grease containment assembly from FIG. 2 taken about cross section line 4*a;*

Referring also now to FIG. 2, the grease containment assembly 20 includes a frame defined by a plurality of elongated members 22 that are positioned against the exhaust duct 14 and below the fan base 16 (FIGS. 1 and 4). While the grease containment assembly 20 is illustrated as being square shaped, it is not intended to be limited by the illustrations, the present invention is importantly designed to fit about the perimeter of the exhaust duct. However, for a typical grease exhaust system 10 that is squared shaped or more importantly includes corners 11 or angled sections, the plurality of elongated members 22 are interconnected about each corner 11 by a corner section 50. But, if the grease exhaust system 10 was irregularly shaped or had a circular perimeter, the frame would be designed to fit around the same. As such the elongated members interconnect to form an inside perimeter 23 that is substantially the same as the outside perimeter of the exhaust duct 14.

It is also important to note that preferably the elongated members and corner sections are made from a light-weight material such as PVC. However, other materials that are also fire retardant may be used.

Figure 3:
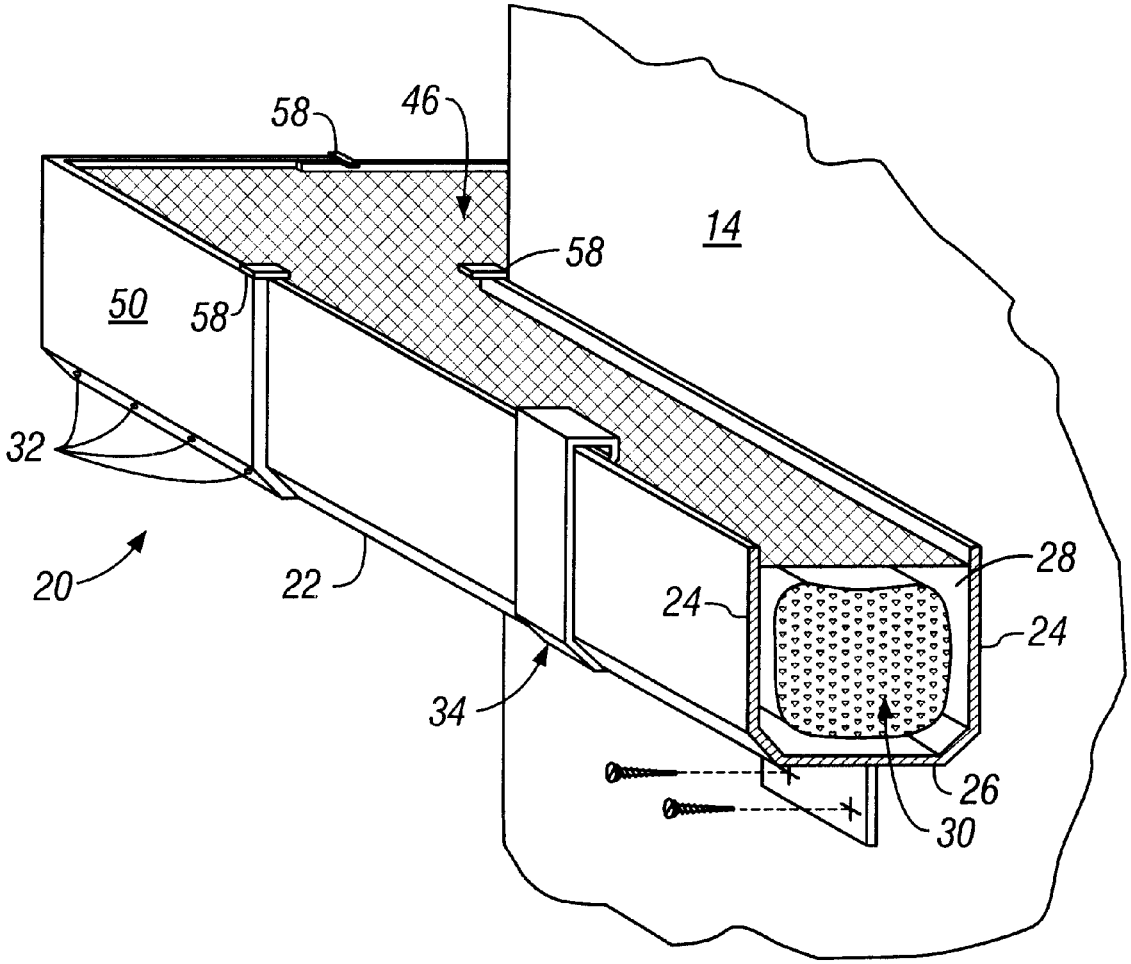
FIG. 3 is a perspective view and partial cross sectional view of the grease containment assembly from FIG. 1.

Referring now to FIG. 3, each elongated member 22 has a U-shaped cross section defined as two side portions 24 that extend upwardly from a bottom portion 26 forming a channel 28 therebetween. The elongated members 22 are positioned against the exhaust duct 14 such that one of the side portions 24 is resting up against the exhaust duct 14. Positioned in the channel 28, also referred to as the interior region, is a sorbent pad 30 that is preferably sized to fit within the two side portions 24 and rest against the bottom portion 26. The sorbent pad 30 is suitable for absorbing air-borne grease discharged from the discharge vent. The sorbent pad 30 is further capable of passing any water landing on the sorbent pad 30 that was either discharged from the discharge vent or caused from precipitation. As opposed to the prior art, where a sorbent pad is positioned up against the exhaust duct 14, which allows grease to seep in between the sorbent pad, the present invention places the sorbent pad 30 entirely within elongated members such that the grease cannot seep in between the sorbent pad 30 and the exhaust duct 14. In addition thereto a portion of the elongated members further includes a plurality of drain holes 32 that drain any water repelled by the sorbent pad 30.

The elongated members 22 are further secured to the exhaust duct 14 such that the elongated members may be raised above the roof 18. Since in some instance the roof 18 may be tilted or unleveled, positioning the grease containment assembly 20 against the roof 18 may cause grease of other fluids to run and collect about a single area, which would cause the sorbet pad 30 to be saturated in an area. As such it is advantageous to attach the grease containment assembly 20 at a level position. The aforementioned securing means is preferably a plurality of support brackets 34.

Referring now to FIG. 4, each support bracket 34 has a first edge 36 and a second edge 38. The first edge 36 is secured to the exhaust duct 14 by screws 37, or other fastening means, while the second edge 38 includes a contour 40 that matches the contour of the elongated member 22 that it is supporting. More specifically, the contour 40 at least supports the bottom portion 26 and the side portion 24 of the elongated member. The second edge 38 further includes a resilient flange 42 that extends around the top portion 25 of the aforementioned side portion 24, such that the flange 42 may engage the side portion 24 thereby securing the elongated member 22 in position against the exhaust duct 14.

To further guide any discharged grease into the grease containment assembly 20, a flash guard 44 may be positioned about the perimeter of the exhaust duct 14 in between the grease containment assembly 20 and the fan base 16. The flash guard 44 may be secured to the exhaust duct 14, by screws 37 or other fastening means, under the fan base 16 such that any grease seeping from the fan base 16 would run down the flash guard 44 and into the grease containment assembly 20.

The grease containment assembly 20 may also include a mesh covering 46 to limit access to the sorbent pad 30. Such limited access may be desired to keep animals out of the grease containment assembly 20 or to protect the sorbent pad 30 from harsh or windy environments. The mesh covering 46 is held in place by clips 48 (FIG. 4) defined in the side portions 24 of the elongated members 22. The clips 48 protruding inwardly towards the center of the elongated member 22 and are further defined to hold the mesh covering 46 in position.

Figure 5:
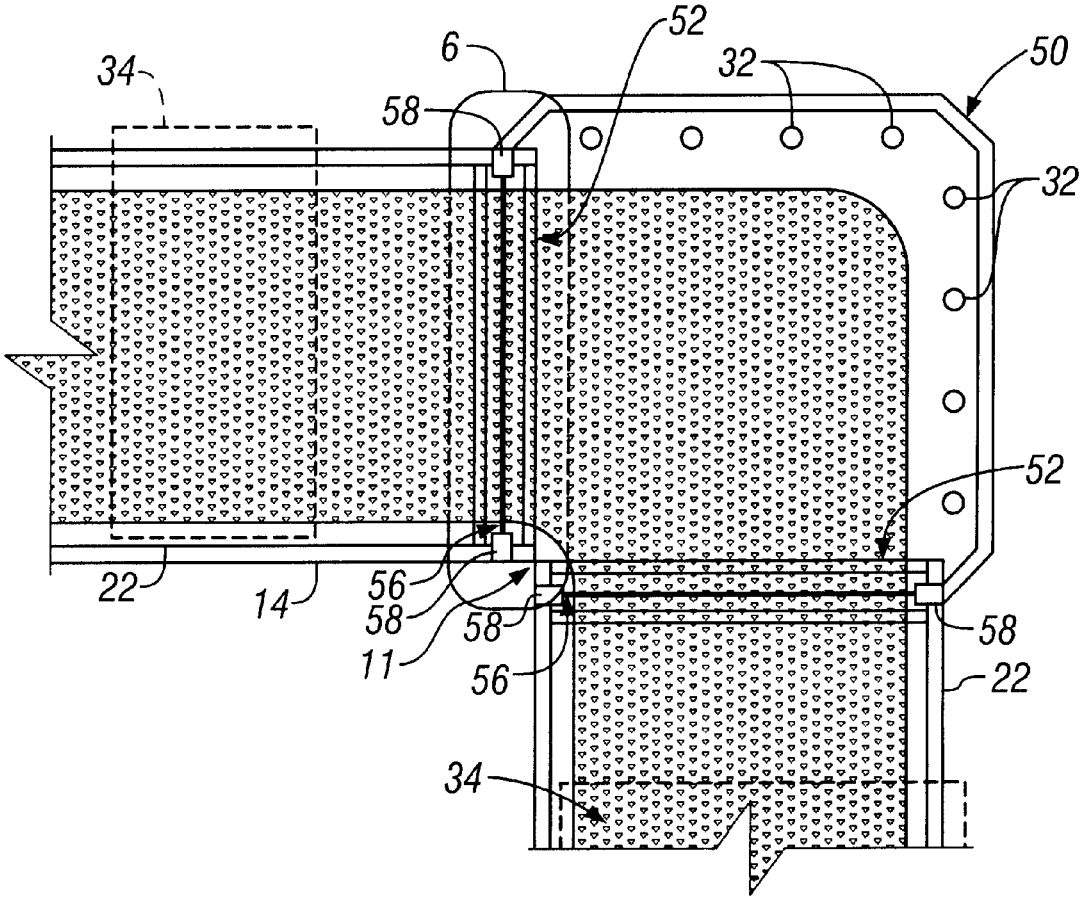
FIG. 5 is a top enlarged view of the corner section of the grease containment assembly from FIG. 2.
Figure 6:
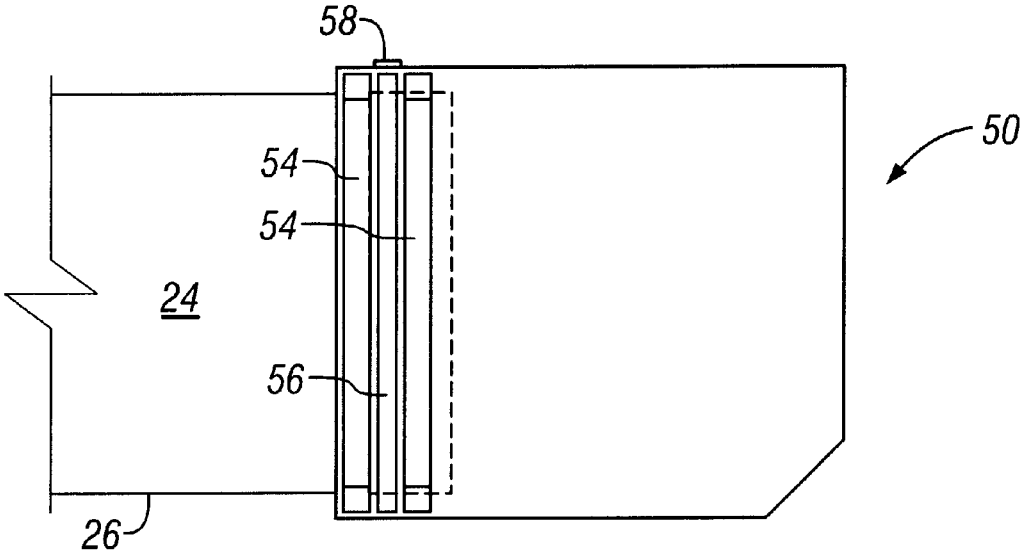
FIG. 6 is a side sectional view of the enlarged corner section about section 6.

Referring now to FIG. 5, two elongated members 22 are connected around a corner 11 by a corner section 50. The corner section 50 includes at least two openings 52 that include a similar but slightly larger contour then the elongated members 22 in order to receive the elongated members 22. In addition, each opening 52 has a support 54 cast into the inside perimeter. The support 54 is defined to receive a U-shaped rubber gasket 56, such that when assembled, the elongated member 22 is positioned into the corner section 50 and onto the rubber gasket 56 thereby creating a seal to prevent grease or other containments from leaking from the grease containment assembly 20. To secure the elongated member 22 into the corner section 50, the corner section 50 includes a pair of opposing resilient tabs 58 that frictionally engage the two side portions 24 of the elongated member. While the plurality of drain holes 32 may be positioned through the elongated members 22, in the embodiment illustrated, the drain holes 32 are positioned in bottom portion of the corner section 50.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

What is claimed is:

1. A grease containment assembly positioned about the perimeter of a grease exhaust system having at least an exhaust duct with a predetermined perimeter that extends from a roof, the exhaust duct further connects to an exhaust fan by a fan base, the grease containment assembly for collecting and containing grease discharged therefrom, comprising:

a plurality of interconnecting elongated members having a U-shaped contour defined by two wall portions extending upwardly from a bottom portion, the elongated members when interconnected having a inside perimeter substantially identical to the predetermined perimeter of the exhaust duct such that the elongated members may be formed around said predetermined perimeter;

a means for securing the elongated members against the exhaust duct, such that one of the wall portions defined by the U-shaped contour is positioned against the exhaust duct;

a sorbet pad sized to fit within the two walls of the elongated members and rest against the bottom portion, the sorbet pad having properties to absorb grease and to repel water; and a plurality of drain hole interspaced about the bottom portion.

2. The grease containment assembly of claim 1, wherein the securing means include a plurality of support brackets, each support bracket has a first edge and a second edge, the first edge is secured to the exhaust duct and the second edge includes a contour that supports the bottom portion and one of the wall portions the elongated member, the second edge further includes a resilient flange that extends around a top portion of the said side portion, such that the flange may engage the side portion securing the elongated member in position against the exhaust duct.

3. The grease containment assembly of claim 2, further comprising:

a mesh covering sized to fit within the elongated members on top of the sorbet pad.

4. The grease containment assembly of claim 3, wherein each side wall includes clips protruding inwardly towards the other side wall for securing the mesh covering to the elongated members.

5. The grease containment assembly of claim 4, further comprising:

a flash guard attached around the perimeter of the exhaust duct between the fan base and the elongated members such that grease sliding down the exhaust vent is directed into the elongated members.

6. The grease containment assembly of claim 1, further comprising:

corner sections to connect elongated members at an angle about the exhaust duct, each corner section having at least two openings to receive at least two elongated members, each opening has a seal positioned therein and a pair of opposing resilient tabs that secure to the side portions of the elongated members such that when the elongated members are positioned and secured to the corner section, the seal prevents at least grease and water from seeping in between the connections.

7. A grease containment assembly to be used in combination with a grease exhaust system having an exhaust duct with a predetermined perimeter that extends upwardly from a roof, an exhaust fan and a fan base that connects the exhaust duct to the exhaust fan, wherein the grease containment assembly collects and contains grease discharged therefrom, comprising:

a frame sized to fit around the entire perimeter of the duct of the exhaust vent, the frame having two walls extending upwardly from a common bottom portion forming an interior region between said walls and common bottom portion, and wherein one of the walls is positioned adjacent to the exhaust duct;

a grease absorbent material capable of repelling water therethrough sized to fit within the interior region of the frame;

a plurality of holes to drain the water within the interior region positioned intermittently along the common bottom portion; and a means to secure the frame to the exhaust duct.

8. The assembly of claim 7, wherein the securing means includes a plurality of support brackets secured into the exhaust duct that support the frame such that the frame is suspended above the roof.

9. The assembly of claim 7 further comprising a flash guard secured to the exhaust duct between the fan base and the frame such that grease sliding down along the fan base is directed into the frame.

10. The assembly of claim 7 further comprising a mesh covering positioned within the interior region and positioned on top of the grease absorbent material.

11. A grease containment assembly to collect grease discharged from a grease exhaust system that has an exhaust duct extending upwardly from a roof top and interconnected to a fan base that connects to an exhaust fan, the grease containment comprising:

a plurality of interconnecting U-shaped channels positioned around the exhaust duct to form a frame surrounding said exhaust duct;

a sorbent material received within the interconnecting channels, the sorbent material capable of absorbing grease and repelling water;

a plurality of holes positioned in the interconnecting channels, the holes may permit the water passing through the sorbent material to drain out of the interconnecting channels; and a means to secure the frame to the exhaust duct above.

12. The grease containment of claim 11, wherein the securing means includes a plurality of support brackets secured to the duct, each support bracket has an edge to engage and support the interconnecting channels.

13. The grease containment of claim 12 further comprising a flash guard positioned around the exhaust duct between the fan base and the frame to direct grease onto the sorbent material.

14. The grease containment of claim 13 further comprising a mesh covering positioned on top of the sorbent material.

15. The grease containment of claim 14, wherein the U-shaped channels are defined by two walls extending upwardly from a bottom portion, and wherein the walls include resilient clips positioned distally from the bottom portion, the resilient clips engage the mesh covering in place.

* * * * *